US006109987A

United States Patent [19]

Watanabe et al.

[11] Patent Number: 6,109,987

[45] Date of Patent: Aug. 29, 2000

[54] COOLANT FLUSHING SYSTEM FOR OUTBOARD MOTOR

[75] Inventors: Hitoshi Watanabe; Takahide Watanabe; Masanori Takahashi, all of Hamamatsu, Japan

[73] Assignee: Sanshin Kogyo Kabushiki Kaisha, Hamamatsu, Japan

[21] Appl. No.: 09/146,094

[22] Filed: Sep. 3, 1998

[30] Foreign Application Priority Data

Sep. 3, 1997 [JP] Japan ..... 9-252690

[51] Int. Cl.[7] ..... B63H 21/38

[52] U.S. Cl. ..... 440/88; 134/166 R

[58] Field of Search ..... 440/88, 113; 134/166 R, 134/167 R, 169 A

[56] References Cited

U.S. PATENT DOCUMENTS 5,634,833 6/1997 Watanabe ..... 440/88
5,873,330 2/1999 Takahashi et al. ..... 440/88

*Primary Examiner*—Jesus D. Sotelo
*Attorney, Agent, or Firm*—Knobbe, Martens, Olson & Bear LLP

[57] ABSTRACT

A water cooled four-cycle outboard motor having an improved flushing system that permits flushing of the cooling system without removal of even the protective cowling and which permits flushing to be accomplished with a minimum of water usage. The flushing connection is coupled with a tell tale connection to provide a simple, but highly effective construction. In addition, the system effectively cools the engine and a temperature sensor is positioned in an area where it will be protected from overheating.

18 Claims, 6 Drawing Sheets

COOLANT FLUSHING SYSTEM FOR OUTBOARD MOTOR

BACKGROUND OF THE INVENTION

This invention relates to an outboard motor and more particularly to an improved flushing and tell tale arrangement for the cooling systems for outboard motors.

As is well known, outboard motors normally have their engines cooled by a liquid cooling system that draws water from the body of water in which the watercraft is operating and which discharges it back to the body of water after it has passed through the various cooling jackets of the engine and its auxiliaries. In this way, the body of water acts a heat exchanger for the engine.

This arrangement provides extreme simplicity and a compact arrangement, which is particularly important in connection with outboard motors. However, the utilization of water from the body of water in which the watercraft is operating for engine cooling can present some problem. For example, many times the body of water may contain certain foreign materials that can cause damage to the engine cooling system. This is particularly true when operating in marine environments wherein the salt in the water could cause corrosion of the engine cooling jacket.

Therefore, it has been the practice to provide some form of flushing system for flushing the cooling jacket of the engine when the engine is taken out of service or even for flushing it periodically during times when it is relatively continuous service.

A wide variety of types of flushing systems have been provided and most of them are relatively complicated in nature. For example, some of these flushing systems employ cuffs or other types of devices that fit around the water inlet opening in the lower unit. Thus, in order to flush the engine cooling jacket, a substantial amount of water must be passed through the system. Also, this flushing path may not ensure that all of the portions of the engine cooling jacket are clean.

Other types of devices have been proposed that require attachment of connections to the actual engine body in order to flush its cooling jacket. Although these devices have advantages over the cuff-type flushing arrangement, it is necessary to remove the protective cowling in order to flush the system. In addition, the flushing communication with the cooling system is not always in a area where it will ensure that the jackets are entirely flushed nor that minimum amounts of water may be required for the flushing.

It is, therefore, a principal object of this invention to provide an improved coolant flushing system for an outboard motor.

It is a further object of this invention to provide a flushing system for the cooling jacket of an outboard motor which does not require either external attachments to the outboard motor or removal of the protective cowling and which nevertheless will provide efficient flushing.

It is a further object of this invention to provide an improved flushing system for the cooling jackets of an outboard motor wherein the flushing connection is made in such a way as to minimize the amount of water required for the flushing operation while, at the same time, ensuring complete flushing of the cooling jackets.

It is a further object of this invention to provide an improved outboard motor construction that employs a built-in flushing arrangement that does not require special fittings, special connections or removal of the protective cowling to effect flushing.

In connection with outboard motor cooling systems, it is generally the practice also to employ a device called a "tell tale". This is an arrangement wherein a portion of the cooling water is bled back to the body of water in which the watercraft is operating from a location where the operator of the outboard motor can visually ascertain that coolant is flowing through the engine cooling jacket. Frequently, the location and positioning of the tell tale's is such that they do not cooperate very effectively with the flushing system and may in fact result in bypassing some of the cooling jackets during the flushing operation. It is, therefore, a still further object of this invention to provide an improved arrangement for flushing an outboard motor engine without interfering with the tell tale operation and without unduly complicating the plumbing connections to the cooling jacket that are required for a flushing operation.

SUMMARY OF THE INVENTION

The features of this invention are adapted to be embodied in the cooling system of an outboard motor powered by a water-cooled internal combustion engine. The outboard motor includes a power head in which the engine is contained and which is surrounded by a protective cowling. A drive shaft housing and lower unit depend from the power head and contain a propulsion device for propelling an associated watercraft through a transmission for driving this propulsion device from the engine. The engine is provided with a cooling system that includes a cooling jacket which extends around the basic engine. Coolant for circulation through this cooling jacket is drawn from the body of water in which the watercraft is operated, passes through a cooling jacket path from an engine cooling jacket inlet and is discharged back to the body of water from an engine cooling jacket outlet.

In accordance with a first feature of the invention, a flushing cooling jacket port is formed in the engine body at a point that is approximately midway between the cooling jacket inlet and the cooling jacket outlet for flushing the engine cooling jacket.

In accordance with another feature of the invention, a flushing conduit is formed that includes a first part that communicates with the engine cooling jacket and a second part that extends outwardly of the protective cowling and has a flexible portion with a hose fitting that is threaded onto a plug mounted on the protective cowling exterior. When detached from this plug, a hose can be connected to the flexible conduit for flushing of the engine cooling jacket.

In accordance with a final feature of the invention, the engine is provided with a tell tale outlet connection from which cooling water is diverted at least in part and discharged through the exterior of the protective cowling in a location where the operator can ascertain that cooling water is passing through the engine cooling jacket. A flushing conduit is also connected to the this connection for the tell tale outlet connection.

DETAILED DESCRIPTION OF THE PREFERRED EMBODIMENT

Figure 1:
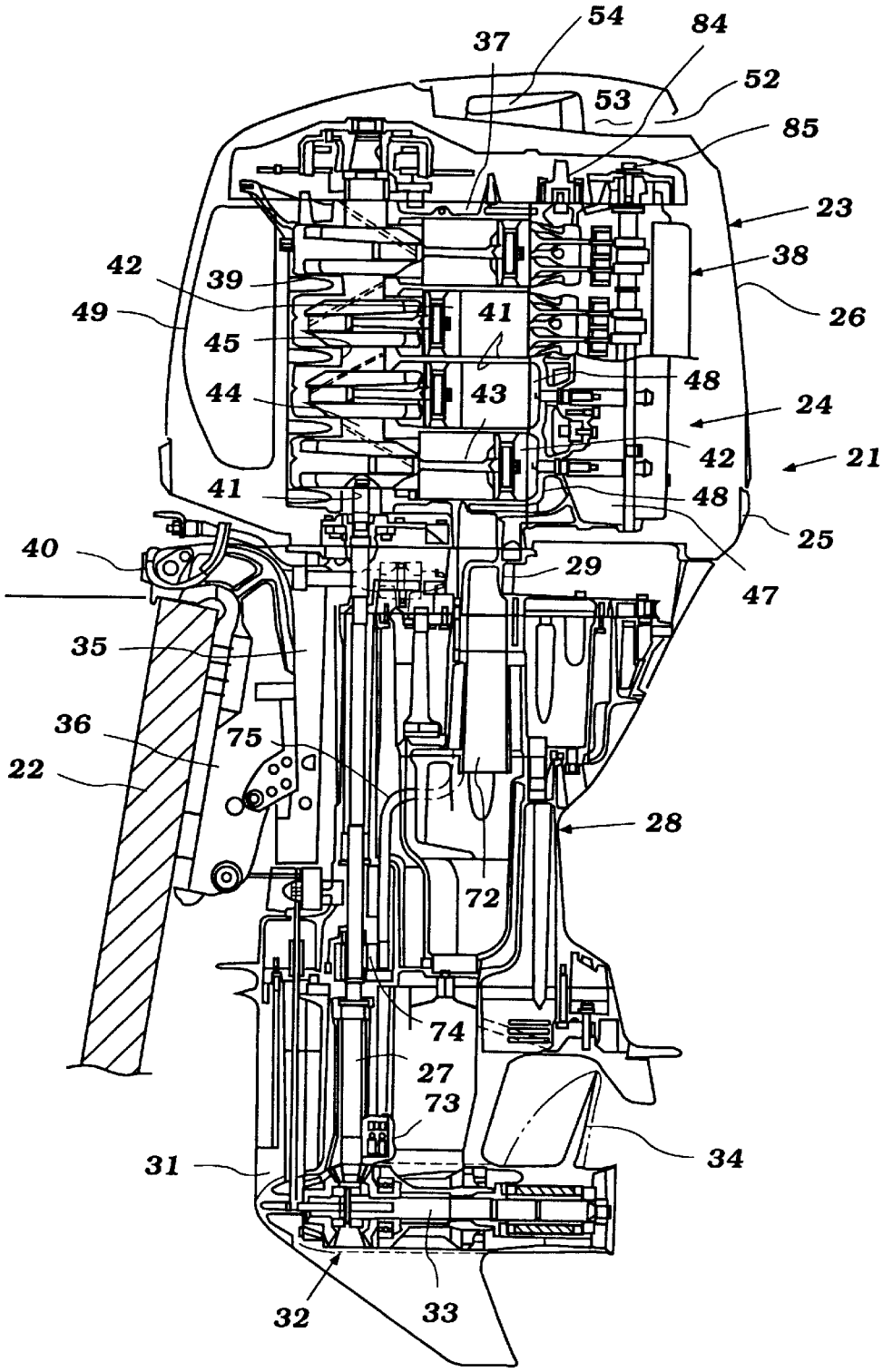
FIG. 1 is a side elevational view of an outboard motor shown in part in section and attached to the transom of an associated watercraft, which is shown partially and in section.

Referring now in detail to the drawings and initially to FIG. 1, an outboard motor constructed in accordance with an embodiment of the invention is indicated generally by the reference numeral 21. In this Figure, the outboard motor 21 is shown attached to the transom 22 of an associated watercraft which is shown partially and in cross section.

The outboard motor 21 is comprised of a power head assembly 23 that consists primarily of a powering internal combustion engine, shown in partial cross section in this view and indicated by the reference numeral 24, and a surrounding protective cowling. This protective cowling includes a lower, tray member 25 and an upper, main cowling member 26 that is detachably connected to the tray member 25 in a suitable arrangement.

As will become apparent as the description proceeds, the engine 24 is mounted in the power head 23 so that its crankshaft (to be described later) rotates about a vertically extending axis. This is typical with outboard motor practice and is done so as to facilitate the connection to a drive shaft 27 which depends into a drive shaft housing lower unit assembly, indicated generally by the reference numeral 28. An exhaust guide 29 and support plate is provided at the upper end of the drive shaft housing 28 and the engine 24 is mounted upon it.

In a lower unit portion 31 of the drive shaft housing and lower unit assembly 28, there is provided a conventional forward neutral reverse bevel gear transmission, indicated generally by the reference numeral 32. This transmission 32 is adapted to drive a propeller shaft 33 that is mounted in the lower unit 31 and to which a propeller 34 is attached. This forward neutral reverse transmission 32 permits selection of the drive of the propeller 34 in forward or reverse propulsion mode or in a neutral condition in which the propeller 34 is not driven.

The drive shaft housing lower unit assembly 28 has affixed to it a steering shaft which is not shown in this figure, but which is mounted for steering movement in a swivel bracket 35 in a manner that is well known in this art. The swivel bracket 35 is, in turn, connected to a clamping bracket 36 by means that include a pivot pin 40 for tilt and trim movement of the outboard motor 21 in a manner which is also well known in this art.

Further details of the construction of the outboard motor 21 except for the engine 24 and its cooling system are not believed necessary to permit those skilled in the art to practice the invention. For that reason, any components of the outboard motor 21 which have not been described or illustrated may be considered to be conventional or any known constructions may be employed to practice the invention.

The construction of the engine 24 will now be described by primary reference to FIGS. 1–5. The engine 24 is comprised of a body made up of three major components comprised of a cylinder block 37, a cylinder head assembly 38 and a crankcase member 39 which are connected together in any known manner.

As may be best seen in FIG. 1, the cylinder block 38 is formed with four vertically spaced, horizontally extending, cylinder bores 41. These cylinder bores 41 may be formed as liners or plated coatings in the cylinder block 37 which is formed primarily from a light alloy.

Pistons 42 are supported for reciprocation in the cylinder bores 41. These pistons 42 are connected by means of piston pins to the small ends of connecting rods 43. Each connecting rod 43 is journaled on a respective throw of the aforementioned crankshaft which appears in this and other figures and which is indicated generally by the reference numeral 44.

Although the invention is described in conjunction with a four-cylinder engine, it should be readily apparent to those skilled in the art how the invention can be employed with engines having other numbers of cylinders and also how the invention can be employed with engines in which the cylinders are disposed at an angle to each other such as with V-type engines.

The crankshaft 44 is journaled within a crankcase chamber that is formed by the cylinder block 37 and the crankcase member 39. This journalling is accomplished by means of bearing surfaces 45 which may be formed integrally with the crankcase member 39 and which cooperate with like bearing surfaces formed in the cylinder block 37. Of course, other arrangements are possible for the journalling of the crankshaft 44, as will become readily apparent to those skilled in the art.

As may be seen in FIG. 1, the lower end of the crankshaft 44 is provided with a splined opening 46 so as to receive the upper end of the drive shaft 27.

Figure 3:
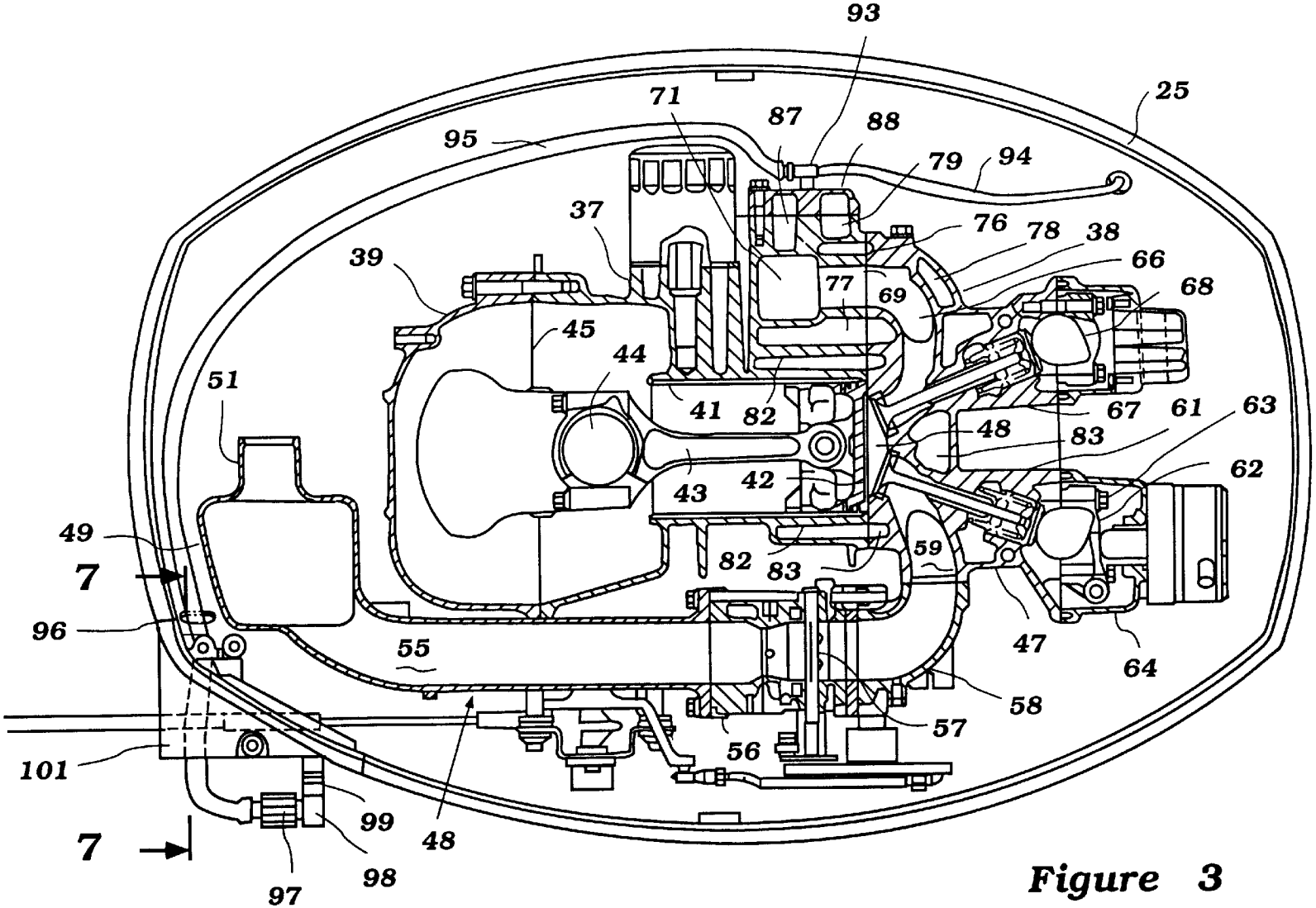
FIG. 3 is a cross-sectional view taken along a horizontal plane passing through one of the engine cylinders.

Referring now primarily to FIGS. 1 and 3, it will be seen that the cylinder head assembly 38 is formed by a main cylinder head member 47 that has individual recesses 48 formed in its lower surface which cooperate with the cylinder bores 41 and pistons 42 so as to form the individual combustion chamber to the engine.

An intake charge is delivered to these combustion chambers by an induction system that is best shown in FIG. 3 and that is indicated generally by the reference numeral 48. This induction system, in the illustrated embodiment, is comprised of an air inlet and silencing device 49 mounted adjacent the forward end of the forward-most surface of the crankcase member 39. An air inlet opening 51 permits air to be drawn into this silencing device from within the protective cowling.

Air is delivered to the interior of the protective cowling by means of a rearwardly facing air inlet opening 52 that is formed in the top of the rear portion of the main cowling member 26. This permits air to be drawn into a chamber 53 for introduction to the interior of the protective cowling through a pair of transversely spaced apart, upwardly extending inlet openings 54. This configuration facilitates the removal or separation of water from the inducted air.

The air collected in the air inlet device 49 is then delivered through a plurality of runner sections 55 to throttle body assemblies 56 in which flow controlling throttle valves 57 are positioned. These throttle valves 57 are operated by a suitable linkage system so as to control the speed of the engine 24 in a manner well known in this art.

The throttle bodies 56 communicate at their downstream ends with an intake manifold 58 which, in turn, forms a portion of the cylinder head assembly 38 and delivers the air charge to intake passages 59 formed in the main cylinder head member 47.

These intake passages 59 terminate at valve seats which are valved by poppet type intake valves 61. In the illustrated embodiment, there are provided two intake valve seats and two intake valve 61 for each cylinder bore 41. Obviously, other types and numbers of valve arrangements may be employed.

The intake valve 61 are urged to their closed positions by means of a suitable spring and keeper arrangement. An intake camshaft 62 is journaled in the cylinder head assembly 38 by means that include bearing caps 63. The intake camshaft 62 has cam lobes that open the intake valves 61 in a manner well known in the art. A cam cover 64 also forms a portion of the cylinder head assembly 38 and encloses the cam chamber in which the intake camshaft 62 rotates.

The intake camshaft 62 is driven at one-half crankshaft speed by means of a drive that includes a flexible transmitter such as a toothed belt 65. This type of cam drive is well known and since it forms no portion of the invention further description of it is not believed necessary to practice the invention.

Fuel is supplied to the combustion chambers of the engine through a suitable fuel charging system. This may be comprised of either carburetors, which can be formed as a part of the throttle bodies 56 or by means of fuel injectors. The fuel injectors may be manifold injectors that inject fuel into the induction system 48 at a suitable location. Alternatively, direct cylinder fuel injection may be employed. Since the method of fuel charge forming forms no part of the invention, it has not been illustrated nor is further description believed to be necessary to permit those skilled in the art to practice the invention.

Spark plugs (not shown) are mounted in the cylinder head assembly 38 and have their spark gaps extending into the combustion chamber recesses 48 of the cylinder head member 47. These spark plugs are fired by a suitable ignition system.

The charge which is ignited by the spark plugs will burn and expand to drive the pistons 42 downwardly in the cylinder bores 41. This motion is then transmitted, as aforenoted, through the connecting rods 43 to the crankshaft 44 to drive it.

The burnt charge is discharged from the combustion chambers through an exhaust system which includes cylinder head exhaust passages 66 which are formed in the cylinder head member 47 on the side opposite the intake passages 59. Like the induction system, the exhaust system may employ two valves per cylinder that valve the valve seats formed at the cylinder head recessed portion 48 of the exhaust passages 66. These exhaust valves are indicated by the reference numeral 67 and are urged to their closed positions in any suitable manner.

An exhaust cam shaft 68 is journaled in the cylinder head assembly 38 in a suitable manner. Like the intake camshaft 62, the exhaust camshaft 67 extends through an upper wall of the cylinder head assembly 38 and has a driving sprocket affixed to this end. The timing belt 65 also is entrained around this sprocket and drives it at one-half crankshaft speed.

Like the intake camshaft 62, the exhaust camshaft 68 is enclosed by the cam cover 64 that is affixed to the main cylinder head member 47 in any known manner.

The exhaust passages 66 terminate in a forwardly facing surface of the cylinder head member 47 that is spaced transversely outwardly from the cylinder bores 41. This terminal ends of the exhaust passages 66 communicates with inlet runners 69 of an exhaust manifold that is formed in the cylinder block 37. This exhaust manifold includes a vertically extending collector section 71.

The lower end of this collector section 71 communicates with an exhaust passage formed in the exhaust guide plate 29. A suitable exhaust system including an exhaust pipe 72 is provided in the drive shaft housing and lower unit 28 for discharging these exhaust gases to the atmosphere (FIG. 1). This exhaust system may include, as is typical with outboard motor practice, a high-speed underwater exhaust gas discharge and a low speed above the water exhaust gas discharge.

The construction of the engine 24 as thus far described may be considered to be conventional. That is, the invention deals primarily with the cooling system and the way the liquid coolant flows through the various cooling jackets of the engine and is returned to the body of water in which the watercraft operates. Therefore, the foregoing description is merely to permit those skilled in the art to understand the environment in which the invention is utilized.

The cooling system will now be described in more detail starting by particular reference to FIG. 1, which merely shows the way the water is picked up and pumped through the engine cooling jackets which will be described shortly by reference to FIGS. 2–6.

Referring first to FIG. 1, it should be seen that the lower unit portion 31 is formed with a water inlet opening 73 that is disposed so that it will be under the level of water under all running conditions of the watercraft. As is typical with outboard motor practice, water is drawn through the inlet opening 73 by a water pump 74. The water pump 74 is driven off of the lower end of the drive shaft 27 at a point where the drive shaft housing and lower unit portions meet.

Figure 5:
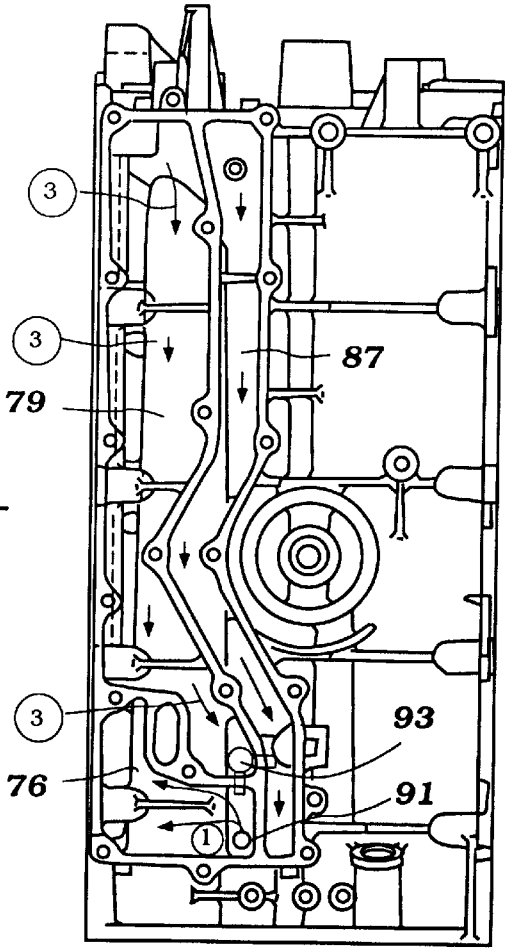
FIG. 5 is a view looking in the direction of the arrow 5 in FIG. 4 with the cover plate for the exhaust manifold cooling jacket removed.
Figure 4:
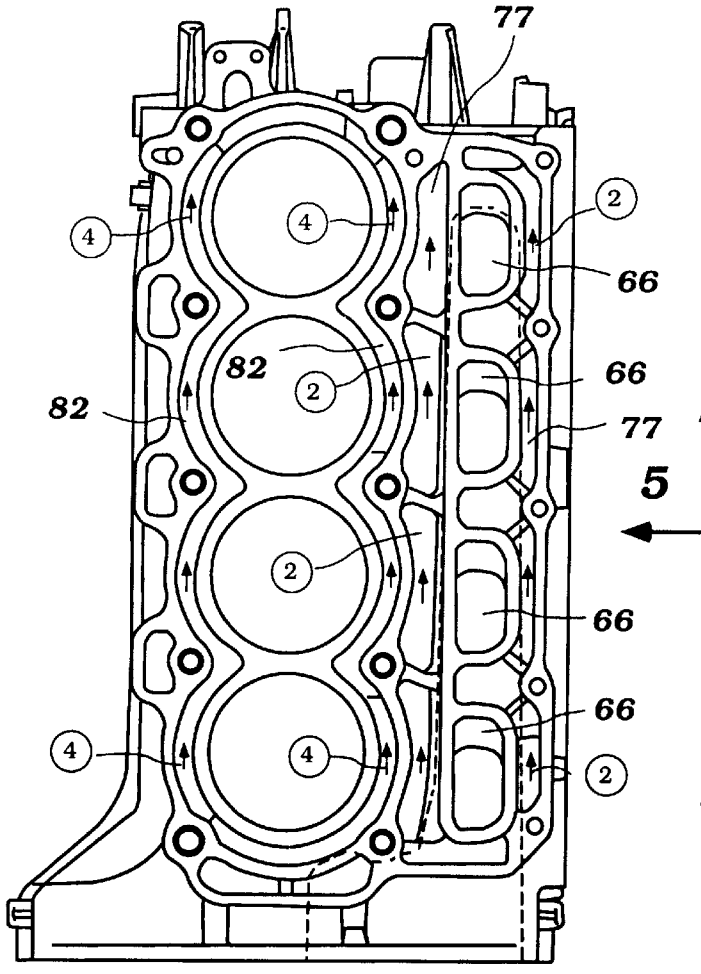
FIG. 4 is a plan view of the cylinder block with the cylinder head and pistons removed so as to more clearly show the actual coolant flow through the engine.
Figure 6:
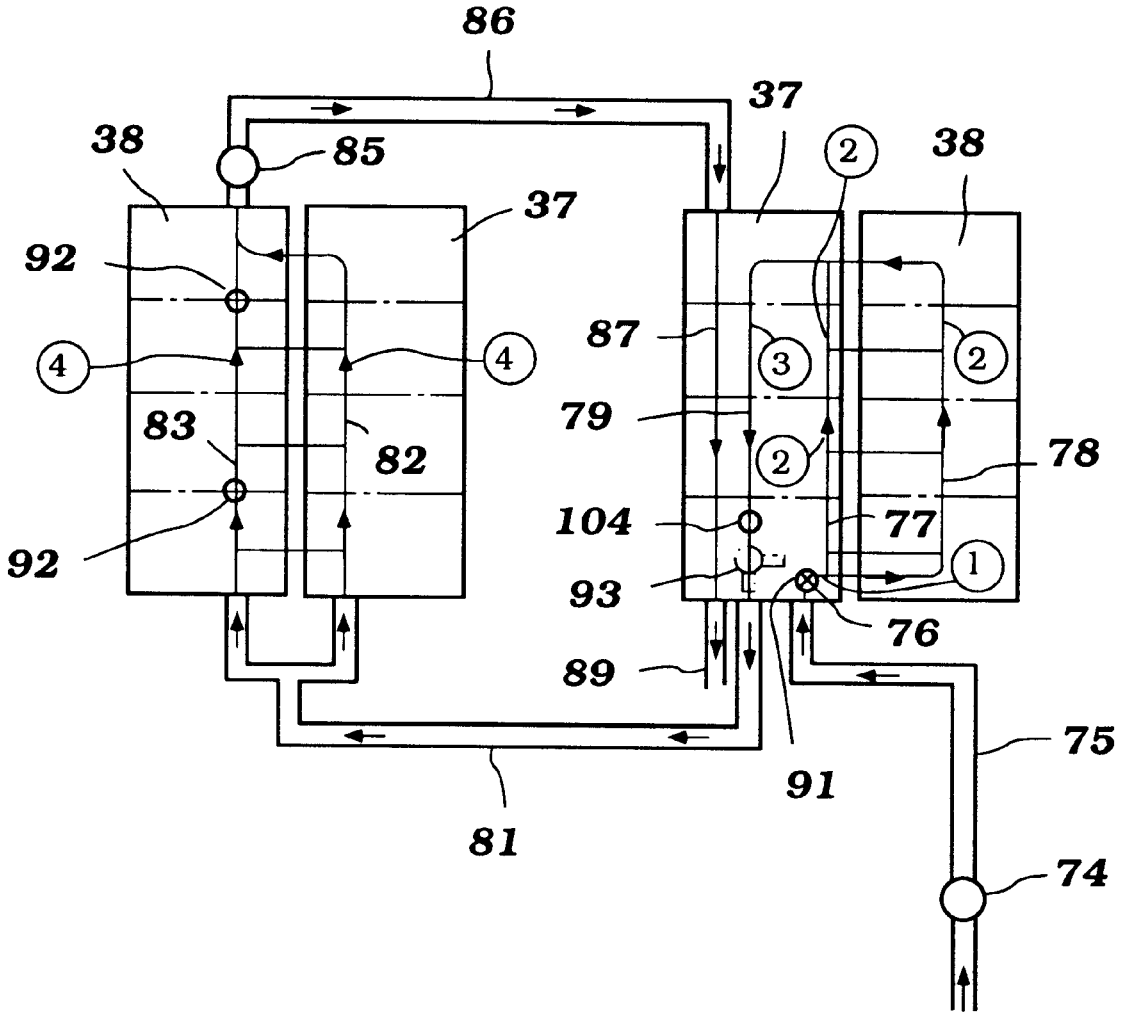
FIG. 6 s a schematic view showing the path of coolant through the engine cooling jacket components.

The coolant is then pumped upwardly through a conduit 75 which also appears schematically in FIG. 6. This cooling water is then delivered to an inlet pocket 76, Flow path ① (FIGS. 5 and 6) that is formed in the lower end of the cylinder block and which communicates with a through passage to the cylinder head 39. This inlet pocket 76 communicates with an upwardly extending cooling jacket 77 formed in the cylinder block 37 and a cylinder head coolant jacket 78 along a flow path, indicated by the reference numeral ②. The path ② extends along the exhaust side of the cylinder head assembly 38 and appears in its actual construction in FIG. 3 and schematically in FIG. 6. The cylinder block passage 77 extends along the opposite sides of the exhaust manifold runners 69. Thus this coolant path ② is disposed in proximity to the point where the exhaust gases are first exiting the combustion chambers and hence, are at their highest temperature.

From this point, the coolant then transferred over back into the cylinder block 37 through a suitable passage formed at the interface between the cylinder head and the cylinder block so as to flow downwardly in a direction indicated by the arrows ③ through a cooling jacket 79 formed in the cylinder block adjacent the exhaust manifold runner sections 69 and collector section 71 formed therein. Again, this is an area where the exhaust gases are most highly heated.

The coolant then flows downwardly through these jacket portions or passages and exits through the lower face of the cylinder block 37 on the exhaust side where it communicates with passages, indicated schematically at 81 in FIG. 6, so as to flow back to the lower side of the main engine body cooling jackets 82 and 83 formed in the cylinder block 37 and the cylinder head 39, respectively, as seen in FIGS. 3 and 6 along the flow paths indicated as ④.

The coolant then flows upwardly through a flow paths ④ and cooling jacket portion 83 formed in the cylinder head. In addition, this water flows upwardly through cooling jacket portions 82 formed on both sides of the cylinder block around the cylinder bores 41 and through to the upper face thereof wherein they terminate in a pocket 84 in the cylinder head shown in FIG. 1.

A thermostat, indicated generally by the reference numeral 85, is provided in this pocket 84. This thermostat 85 controls the flow through a return passage, indicated schematically at 86 in FIG. 6 which then communicates with a downwardly directed exhaust side cooling jacket portion 87 formed in the cylinder block (FIGS. 3 and 6) through a flow path indicated as ⑤.

Figure 2:
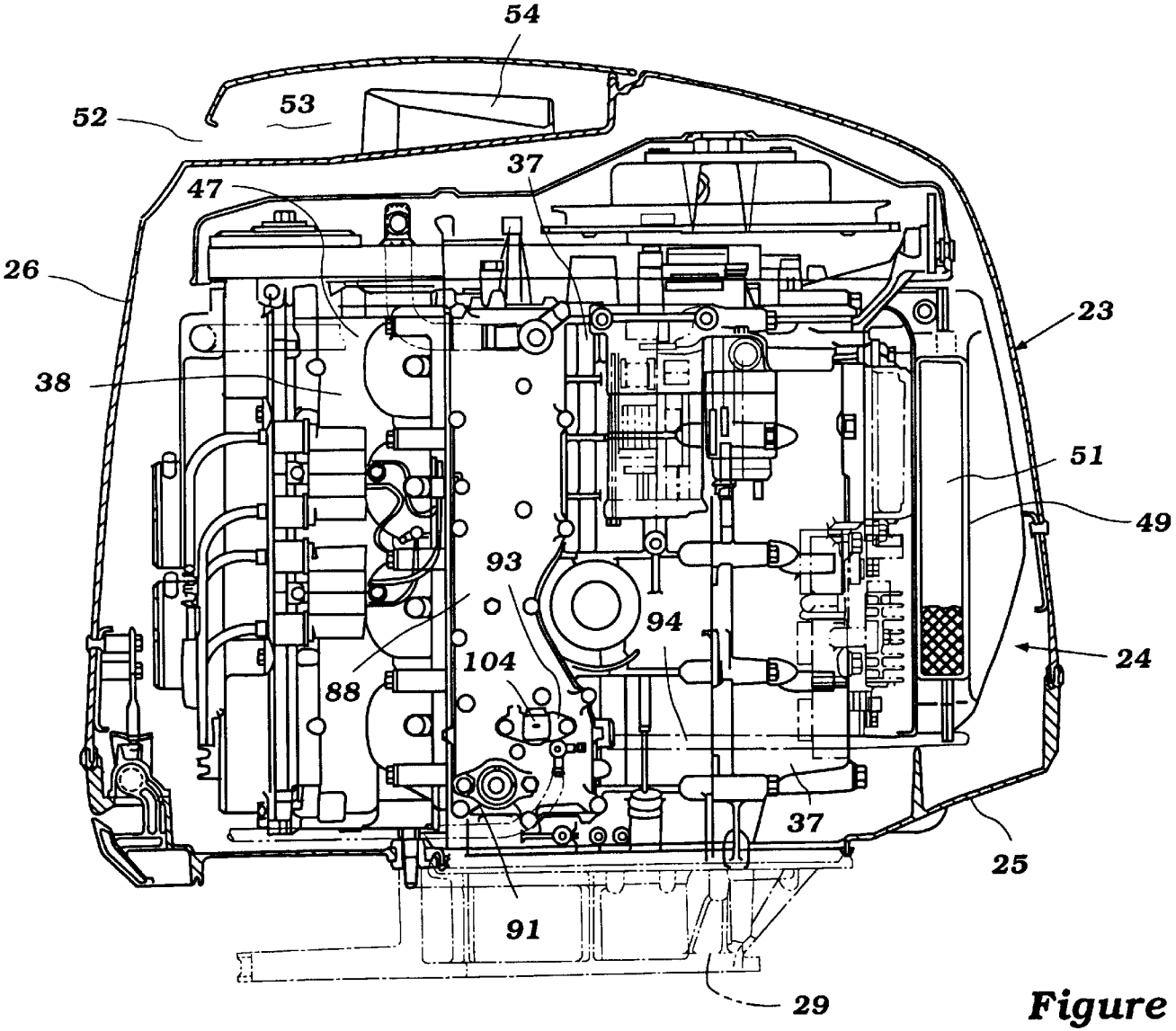
FIG. 2 is an enlarged side elevational view of the power head of the outboard motor, looking in the direction opposite to that of FIG. 1 and with the protecting cowling shown in cross section to illustrate the external configuration of the engine.

It should be noted as best seen in FIGS. 2 and 3 that the cooling jacket portions 79 and 87 formed on the side of the cylinder block 37 adjacent the exhaust manifold portions 69 and 71 are actually open through the outer side of the cylinder block 37. A cover plate 88 is affixed across the open ends thereof so as to close this flow path so as to direct the water in the desired path.

This water is then discharged back to the body of water in which the watercraft is operating through a return, indicated schematically at 89 in FIG. 6. Some of this cooling water may be mixed with the exhaust gasses to cool them to assist in the exhaust silencing.

As seen in FIGS. 2, 5 and 6, at the point where the cooling water first enters the cylinder block 37 from the conduit 75 and is transferred immediately through the cooling jacket pocket 76, there is provided a sacrificial anode 91 of any known type for corrosion protection at the point where the water will first come into contact with the exhaust manifold cooling jacket portion 77. Thus, the exhaust manifold, which may be formed in part from a cover plate that may be formed from a material other than that of the cylinder block, i.e., the plate 88, will be subject to galvanic protection.

Corrosion protection anodes, indicated generally by the reference numeral 92, shown schematically in FIG. 6 are mounted in clean-out openings (not shown) formed in the cylinder head 39 in communication with its cooling jacket portions 83.

As best seen in FIGS. 2, 3, 5 and 6, a three-way fitting 93 is affixed to the cylinder block 37 in proximity to the lower or outlet end of its water jacket portion 79 which lies at the downward end of the flow path ③. This fitting is disposed approximately midway of the flow path through the engine from the inlet conduit 75 to the outlet conduit 89.

A first, tell tale hose or conduit 94 extends from this fitting 93 to a place in the lower tray 25 where it extends outwardly so as to discharge a small tell tale stream of cooling water that will let the operator know that coolant is being circulated through the engine cooling jacket. These tell tale devices are well known in the art although they are not always positioned in this particular manner.

In addition, a flushing conduit 95 having a larger diameter is affixed to a larger diameter portion of the fitting 93 and extends forwardly across the front of the outboard motor power head and exits through an opening 96 formed in a lower portion of the tray 25. A female type hose fitting 97 is affixed to the outer end of this flexible conduit 96. This hose fitting 97 may be threaded on to a male plug 98 mounted on a mounting bracket 99 formed on the tray 25. Thus, during normal outboard motor operation, there will be flow through the conduit 95 and only a restricted small flow through the tell tale hose 94.

However, if the operator wishes to flush the engine cooling jacket, the fitting 97 is removed from the plug 98 by unscrewing it. Then, a male end of a conventional garden hose may be connected to the fitting 97 and flushing water turned on. Some of this water will flow out of the tell tale 94 to permit the operator to know that the flushing is occurring but the bulk of the water, because of the higher pressure, will pass through the cooling jackets 79 and 77 of the cylinder block 37 and 78 of the cylinder head 38 and the discharge back through the inlet conduit 75 to the body of water in which the watercraft is operating through the normal flow inlet path.

In addition, a stream of water will flow through the conduit 89 and cylinder block and cylinder head coolant jackets 82 and 83, past the thermostat 85 through the return conduit 86 and out the cylinder block discharge path 87 through the normal water discharge conduit 89 from the engine coolant jacket. Thus, the entire cooling system will be flushed and a minimum amount of water will be consumed for this purpose since the flow is split entering the engine through the center of its cooling system and being discharged through the normal inlet and outlet fittings thereto. Thus, very effective flushing is possible and the operator need not even remove the protective cowling to accomplish this flushing.

Figure 7:
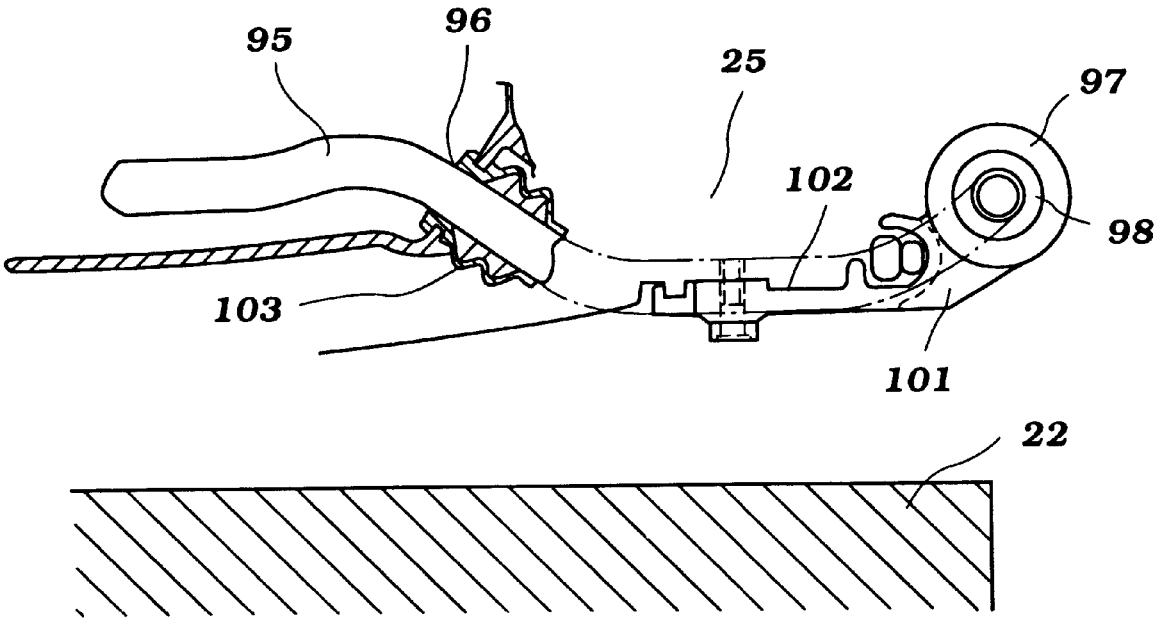
FIG. 7 is an enlarged view taken along the line 7—7 of FIG. 3 showing the flushing connection for the cooling jacket.

As best seen in FIG. 7, the flushing conduit 95 may be supported on a mounting bracket 101 that is fixed on the outboard motor tray 25 and located by a slot 102. A bellows seal 103 may be provided between the opening 96 and the conduit 95. As may be seen, this is an area that is above the upper end of the watercraft transom 22 so as to facilitate this servicing.

Finally, the cooling system also employs a temperature sensor 104 (FIGS. 2 and 6) for sensing engine temperature. The temperature sensor 104 is mounted in the cover plate 88 which closes the cooling jackets formed in the cylinder block, as aforenoted. As may be seen in FIG. 6, this temperature sensing element is positioned at the outlet side of the exhaust manifold cooling jacket portion 79 and thus, it will not see the cold water which is first admitted into this cooling jacket nor will it see the extremely highly heated water that is discharged from the discharge conduit 89 at the end of the circuit.

As a result, this temperature sensing element 104 will have a temperature that is more closely related to average actual engine temperature and not either of the extremes. This will ensure long life. Also because of the low mounting position the likelihood of overheating and damage when the engine is stopped and the water may drain from the cooling jackets is also minimized.

Thus, from the foregoing description it should be readily apparent that the outboard motor cooling system is very effective, affords simple flushing and a very easy tell tale operation. Of course, the foregoing description is that of a preferred embodiment of the invention and various changes and modifications may be made without departing from the spirit and scope of the invention, as defined by the appended claims.

What is claimed is:

1. An outboard motor powered by a water-cooled internal combustion engine, said outboard motor including a power head in which said engine is contained and which is surrounded by a protective cowling, a drive shaft housing and lower unit depending from said power head and containing a propulsion device for propelling an associated watercraft through a transmission for driving said propulsion device from said engine, said engine being provided with a cooling system that includes a cooling jacket which extends around a body of said engine, means for drawing coolant for circulation through said cooling jacket from the body of water in which the watercraft is operated, passing the drawn coolant through a cooling jacket flow path from an engine cooling jacket inlet and for discharging the circulated coolant back to the body of water from an engine cooling jacket outlet, and a flushing cooling jacket port formed in said engine body at a point that is approximately midway along the length of said cooling jacket flow path between said cooling jacket inlet and said cooling jacket outlet for flushing said engine cooling jacket.

2. An outboard motor as set forth in claim 1 further including a flushing conduit having a first part that communicates with the engine cooling jacket flushing port and a second part that extends outwardly of the protective cowling and has a flexible portion with a hose fitting that is threaded onto a plug mounted on the exterior of said protective cowling for selective connection to a hose for flushing of the engine cooling jacket.

3. An outboard motor as set forth in claim 1 wherein the engine body is comprised of a cylinder block having at least two horizontally extending cylinder bores and a cylinder head affixed to said cylinder block and closing one end of said cylinder bores, each of said cylinder head and said cylinder block forming respective portions of the cooling jacket.

4. An outboard motor as set forth in claim 3 wherein the cooling jacket is comprised of a first, ascending portion formed at least in the cylinder head extending upwardly from the cooling jacket inlet; a second, descending portion formed at least in part in the cylinder block extending downwardly from said first, ascending portion; a third, ascending portion formed at least in said cylinder head extending upwardly from said second, descending portion; and a fourth, descending portion formed at least in part in said cylinder block extending downwardly from said third, ascending portion to the cooling jacket outlet.

5. An outboard motor as set forth in claim 4 wherein the first, ascending portion communicates with the cooling jacket inlet through the cylinder block.

6. An outboard motor as set forth in claim 4 wherein the third, ascending portion is also formed in the cylinder block.

7. An outboard motor as set forth in claim 6 wherein the first, ascending portion communicates with the cooling jacket inlet through the cylinder block.

8. An outboard motor as set forth in claim 7 wherein the first, ascending portion is in close proximity to an exhaust passage formed in the cylinder head.

9. An outboard motor as set forth in claim 4 wherein the first, ascending portion is in close proximity to an exhaust passage formed in the engine body.

10. An outboard motor as set forth in claim 4 further including a flushing conduit having a first part that communicates with the engine cooling jacket flushing port and a second part that extends outwardly of the protective cowling and has a flexible portion with a hose fitting that is threaded onto a plug mounted on the exterior of said protective cowling for selective connection to a hose for flushing of the engine cooling jacket.

11. An outboard motor powered by a water-cooled internal combustion engine, said outboard motor including a power head in which said engine is contained and which is surrounded by a protective cowling, a drive shaft housing and lower unit depending from said power head and containing a propulsion device for propelling an associated watercraft through a transmission for driving said propulsion device from said engine, said engine being provided with a cooling system that includes a cooling jacket which extends around a body of said engine, means for drawing coolant for circulation through said cooling jacket from the body of water in which the watercraft is operated, passing the drawn coolant through said cooling jacket from an engine cooling jacket inlet and for discharging the circulated coolant back to the body of water from an engine cooling jacket outlet, said engine cooling jacket being comprised of a first, ascending portion extending upwardly from the cooling jacket inlet; a second, descending portion extending downwardly from said first, ascending portion; a third, ascending portion extending upwardly from said second, descending portion; and a fourth, descending portion extending downwardly from said third, ascending portion to the cooling jacket outlet.

12. An outboard motor as set forth in claim 11 further including a flushing cooling jacket port formed in said engine body contiguous to the juncture of the second, descending portion and the third, ascending portion for flushing said engine cooling jacket.

13. An outboard motor as set forth in claim 12 further including a thermostat for controlling the communication between the third, ascending portion and the fourth, descending portion.

14. An outboard motor as set forth in claim 13 further including a flushing conduit having a first part that communicates with the engine cooling jacket flushing port and a second part that extends outwardly of the protective cowling and has a flexible portion with a hose fitting that is threaded onto a plug mounted on the exterior of said protective cowling for selective connection to a hose for flushing of the engine cooling jacket.

15. An outboard motor powered by a water-cooled internal combustion engine, said outboard motor including a power head in which said engine is contained and which is surrounded by a protective cowling, a drive shaft housing and lower unit depending from said power head and containing a propulsion device for propelling an associated watercraft through a transmission for driving said propulsion device from said engine, said engine being provided with a cooling system that includes a cooling jacket which extends around a body of said engine, means for drawing coolant for circulation through said cooling jacket from the body of water in which the watercraft is operated, passing the drawn coolant through a cooling jacket path from an engine cooling jacket inlet and for discharging the circulated coolant back to the body of water from an engine cooling jacket outlet, and a flushing conduit having a first part that communicates directly with said engine body and therethrough with said engine body cooling jacket downstream of said engine cooling jacket inlet and a second part that extends outwardly of the protective cowling and has a flexible portion with a hose fitting for connection to a hose for flushing of said engine cooling jacket.

16. An outboard motor as set forth in claim 15 further including a plug mounted on the protective cowling exterior for receiving and closing the hose fitting.

17. An outboard motor as set forth in claim 16 further including a tell tale outlet connection from which cooling water is diverted at least in part and discharged through the exterior of the protective cowling in a location where the operator can ascertain that cooling water is passing through the engine cooling jacket, the flushing conduit being connected to said tell tale outlet connection.

18. An outboard motor powered by a water-cooled internal combustion engine, said outboard motor including a power head in which said engine is contained and which is surrounded by a protective cowling, a drive shaft housing and lower unit depending from said power head and containing a propulsion device for propelling an associated watercraft through a transmission for driving said propulsion device from said engine, said engine being provided with a cooling system that includes a cooling jacket which extends around a body of said engine, means for drawing coolant for circulation through said cooling jacket from the body of water in which the watercraft is operated, passing the drawn coolant through a cooling jacket path from an engine cooling jacket inlet and for discharging the circulated coolant back to the body of water from an engine cooling jacket outlet, a tell tale outlet connection from which cooling water is diverted at least in part and discharged through the exterior of said protective cowling in a location where an operator can ascertain that cooling water is passing through said engine cooling jacket, and a flushing conduit connected to said tell tale outlet connection for selective flushing of said engine cooling jacket.

* * * * *